US006216934B1

(12) United States Patent
Searles

(10) Patent No.: US 6,216,934 B1
(45) Date of Patent: Apr. 17, 2001

(54) FESTOON PROTECTION METHOD AND SYSTEM

(76) Inventor: Timothy J. Searles, W397 County Road. E, Brodhead, WI (US) 53520

( * ) Notice: Subject to any disclaimer, the term of this patent is extended or adjusted under 35 U.S.C. 154(b) by 0 days.

(21) Appl. No.: 09/152,856

(22) Filed: Sep. 14, 1998

(51) Int. Cl.[7] ..... B23Q 16/00; B65H 20/30; F16F 5/00

(52) U.S. Cl. ..... 226/11; 226/118.2; 242/417.1; 267/114

(58) Field of Search ..... 226/1, 8, 11, 118.2, 226/118.3, 44; 242/417.1, 417.2, 417.3; 188/266.2, 281, 300; 267/64.12, 114, 120

(56) References Cited

U.S. PATENT DOCUMENTS 3,025,017 * 3/1962 Wahlstrom ..... 242/417.2
3,796,360 * 3/1974 Alexeff ..... 226/118.2
4,033,522 * 7/1977 Chesnut et al. ..... 242/417.3 X
5,031,847 * 7/1991 Tanaka ..... 226/11 X
5,810,236 * 9/1998 Yashida et al. ..... 226/118.3

* cited by examiner

*Primary Examiner*—Michael R. Mansen
(74) *Attorney, Agent, or Firm*—McAndrews, Held & Malloy, Ltd.

(57) ABSTRACT

A method and system for preventing damage to a movable dancer assembly in a festoon upon the breakage of the running web that runs through the festoon. During normal running of the web, the vertical position of the dancer assembly, in the festoon and vis-à-vis the fixed entry and exit idlers of the festoon, is controlled by a dancer tensioning cylinder assembly that includes a cylinder and a piston which is connected with the dancer assembly and which is movable in the cylinder in response to pressurized air in a first portion of the cylinder and applied to a first surface of the piston. Upon the breaking of the running web, air pressure is permitted to increase in a second portion of the cylinder and is applied to the second, opposite surface of the piston until the pressure of the air in the first and second positions becomes equal. After a preselected delay after the running web breaks, the pressurized air in the first and second portions of the cylinder is bled from the cylinder.

10 Claims, 2 Drawing Sheets

FESTOON PROTECTION METHOD AND SYSTEM

BACKGROUND OF THE INVENTION

The present invention relates to a method and system for preventing damage to a festoon should a break in a running web occur while the web is being unwound from a rotating roll, being run through the festoon, and then run to a web-using production process.

The inclusion of festoons in systems for controlling the speed and tension of running webs has been recognized as a significant improvement. Such festoons, which are capable of storing variable amounts or quantities of the running web, typically include, in simplified form, a fixed entry idler, a relatively movable dancer and a fixed exit idler. The web runs about the entry idler, the dancer and then the exit idler. A dancer tensioning cylinder assembly is connected with the dancer and is adapted to urge the dancer upwardly, vertically with respect to the fixed idlers and against the force of the web running over and about that dancer.

The dancer tensioning cylinder assembly includes a piston, which is disposed for reciprocal movement within a cylinder, which is connected to the dancer by, for instance, a cable, and to which controlled, pressurized air is applied to one surface or face of the piston so as to force the piston to move in one direction within the cylinder. Upward movement of the dancer may occur in response to movement of the piston in the one direction in the cylinder.

In the past, a break in the running web could and often did cause damage to the festoon. The break would remove the web-generated force that opposed the upwardly directed force imposed on the dancer by the dancer tensioning cylinder assembly. Upon this removal, the dancer would tend to move suddenly, upwardly in the festoon. Such out-of-control, upward movement sometimes caused the dancer to strike the festoon's supporting structure, thus damaging the dancer and/or the festoons supporting structure. Repair of such damage could be costly particularly in terms of the down time of the web-using production process.

BRIEF SUMMARY OF THE INVENTION

In principal aspects, the present invention provides an improved method and system for controlling and limiting the heretofore out-of-control upward movement of the dancer upon a breakage of the running web. The present invention is thus able to prevent damage to the festoon and to minimize down time of the web-using production process should a break in the running web occur.

This control and limitation of the upward movement of the dancer is achieved by controlling the movement of the piston in the dancer tensioning cylinder assembly. The piston is controlled by substantially instantaneously equalizing the air pressures applied to the opposite surfaces or faces of the piston after a web break occurs, and then after a preselected delay, bleeding the air pressures off. This equalization stops the movement of the piston, and in turn, stops the upward movement of the dancer by removing the force that would otherwise have been imposed on the dancer by the dancer tensioning cylinder assembly.

Accordingly, a principal object of the present invention is to provide an improved method and system for controlling and limiting the upward movement of the dancer of a festoon when the running web breaks.

Another object of the present invention is to provide an improvement in a system for controlling the speed and tension of a running web being unwound from a rotating roll and being run through an festoon and then to a web-using production process, where the festoon includes a relatively fixed idler, a relatively fixed exit idler, and a vertically movable dancer about which the running web runs; where the dancer may be moved vertically relatively with respect to the idlers depending on the amount or quantity of running web being stored in the festoon; where the dancer is connected with a dancer tensioning cylinder assembly that is used to urge the dancer vertically, against the force of the running web running over the dancer and that includes a cylinder, which has a first end and a second end, and a piston, which is connected with the dancer, which is movable within the cylinder, and which has a first surface facing the first end of the cylinder and a second surface facing the second end of the cylinder; where the first portion of the cylinder is defined between the first end of the cylinder and the first face of the piston; where the piston is movable within the cylinder in response to the air pressures being applied to and acting on the first surface of the piston; where the system includes a source of air under pressure that is adapted to be applied to the first portion of the cylinder and an air regulator for regulating the pressure of the pressurized air supplied to the first portion of the cylinder; and the improvement includes a first check valve that is adapted to move between a first position in which the second portion of the cylinder (that is defined between the second end of the cylinder and the second surface of the piston) is open to the atmosphere and a second position in which the second portion of the cylinder is closed to the atmosphere so that the pressure of the air in the second portion may increase so as to become equal with that of the pressure of the air in the first portion of the cylinder; where the first valve moves from its first position to its second position when a breakage of the running web occurs; and where the system further includes an air flow restrictor that permits air in the second portion of the cylinder to bleed from the second portion after a preselected delay after a break in the running web has occurred. A related object of the present invention is to provide an improved system, as described, where the system includes a second valve that is adapted to be moved between a first position in which the source of pressurized air is connected with the first portion of the cylinder and a second position in which the source of pressurized air is disconnected from the first portion of the cylinder, and after a preselected delay, the pressurized air in the first portion of the cylinder is permitted to bleed from the first portion of the cylinder; and where the system also further includes a sensor that is adapted to sense a breakage of the running web, and in response to such breakage, to activate the second valve so as to move the second valve from its first position to its second position.

Still another object of the present invention is to provide an improvement in a method for controlling the speed and tension of a running web being unwound from a rotating roll and being run through an festoon and then to a web-using production process where the improvement comprising the steps of sensing the occurrence of a break in the running web; causing the pressure of the air in the second portion of the cylinder of dancer tensioning cylinder assembly, which is normally open to the atmosphere, to increase so that the air pressure in the second portion of the cylinder becomes equal to the air pressure in the first portion of the cylinder; and after a preselected delay after the break in the running web, bleeding the pressurized air from the cylinder. A related object to the present invention is to provide an improved method, as described, whereafter a break in the running web occurs, the first portion of the cylinder is disconnected from the source of pressurized air, and after a preselected delay, the pressurized air in that first portion is bled off.

These and other objects, advantages and benefits of the present invention will become more apparent from the following description of the preferred embodiment of the present invention, which description may be best understood with reference to the accompanying drawing.

DETAILED DESCRIPTION OF THE PREFERRED EMBODIMENT OF THE INVENTION

Figure 1:
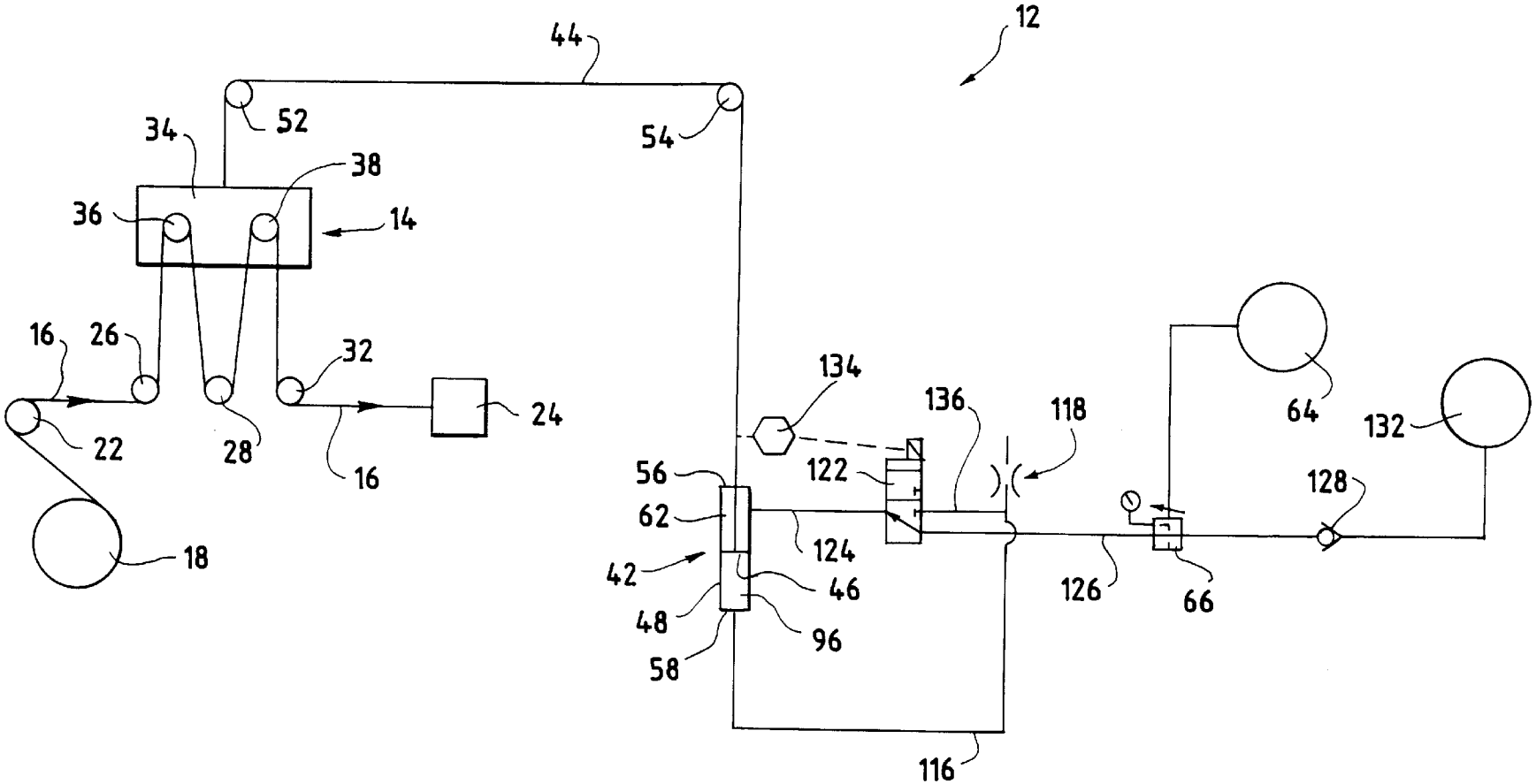
FIG. 1 is a schematic view of the preferred embodiment of the improved system for controlling the speed and tension of a running web and for preventing damage to the festoon should the running web break.

Referring now to FIG. 1, the preferred embodiment of the improved system of the present invention is shown generally at 12. The system 12 includes a conventional festoon 14 that may be inertia compensated and that is adapted to receive and store variable amounts or quantities of a continuous running web 16. As illustrated in FIG. 1, the running web 16 is being unwound from a rotating roll 18 that is mounted for rotation in a conventional manner. Between the rotating roll 18 and the festoon 14, the web 16 may pass about idlers, one of which is shown at 22. After running through the festoon 14, the running web passes to a web-using production process 24 such as, for example, a disposable diaper manufacturing line.

The running web 16 passes through the festoon 14 in a conventional manner. In simplified form, as illustrated, the festoon 14 includes fixed entry, intermediate and exist idlers, 26, 28 and 32, respectively, and a vertically, relatively movable dancer assembly 34 which includes, as shown, two idlers 36 and 38. The web 16 runs about the idlers 26, 36, 28, 38 and 32, respectively, as it passes through the festoon 14.

As shown in FIG. 1, the dancer assembly 34 is movable vertically, with respect to the idlers 26, 28 and 32, depending on the amount or quantity of running web 16 being stored in the festoon. A larger or greater quantity of running web 16 is being stored in the festoon when the dancer assembly 34 is at a higher position, that is, spaced farther vertically from the idlers 26, 28 and 32, then when the assembly 34 is in a lower position, that is, spaced closer vertically to the idlers 26, 28 and 32.

As is typical with such festoons, a dancer tensioning cylinder assembly 42 is connected with the dancer assembly 34 and is used to urge the dancer assembly 34 to its uppermost vertical position, with respect to the idlers 26, 28 and 32. More specifically, the assembly 42 includes a piston 46, which is reciprocally movable within a cylinder 48. A cable 44, or the like, interconnects the piston 46 with the assembly 34. In a conventional manner, the cable 44 extends upward from the assembly 34, passes about two idlers 52 and 54, extends through the upper end 56 (as shown) of the cylinder 48, and is attached to the piston 46. As is also conventional, movement of the piston 46 in one direction, that is, toward the FIG. 1 illustrated lower end 58 of the cylinder 48, will urge the dancer assembly 34 to move upwardly, away from the idlers 26, 28 and 32, against the bias or force exerted by the running web 16 on the dancer assembly 34.

As is also conventional, the piston 46 is urged to move toward the lower end 58 of the cylinder 48 by the application of air under pressure to the portion 62 of the cylinder, which is defined by the cylinder end 56 and the surface or face of the piston 46 adjacent to the end 56. The pressurized air may come from a conventional source 64 of pressurized air. A conventional pressure regulator 66 may be used to regulate and control the pressure of the air being applied in the cylinder portion 62 so that the festoon 14 will function in the conventional manner.

As discussed above, the running web 16 may break, on occasion, as it runs to the production process 24. In the past, such web breakage could damage, sometime seriously the festoon 14. More particularly, web breakage will cause the dancer assembly 34 to move upwardly, by reason of the force exerted on the cable 44 by the air cylinder assembly 42. This sudden, uncontrolled upward movement can cause the dancer assembly 34 to strike the supporting structure of the festoon 14 with sufficient force to damage the festoon, including the dancer assembly.

As previously stated, the present invention prevents such uncontrolled, upward movement of the dancer assembly 34 upon a breakage of the running web 16. The invention achieves this by the inclusion of a check valve 68 in the end 58 of the cylinder 48.

Figure 2:
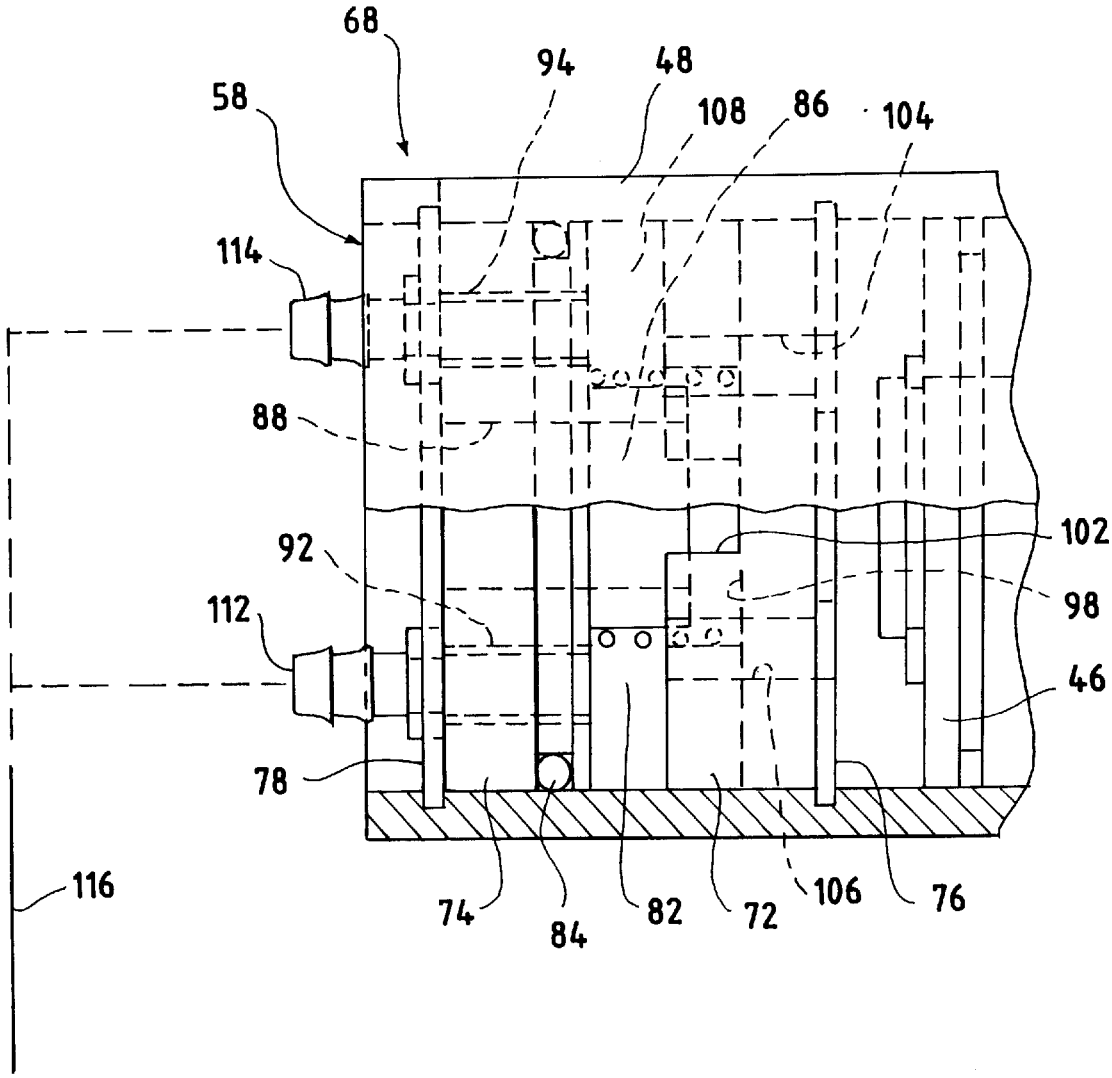
FIG. 2 is partial, axial cross-sectional view of the check valve mounted in the dancer tensioning cylinder assembly of the system of FIG. 1.

More particularly, and as best shown in FIG. 2, the check valve 68 includes a movable valve poppet member 72 and a relatively fixed valve base member 74. The poppet member 72 may reciprocally move, axially, toward and away from the member base 74 within the cylinder 48. A snap ring 76 limits the distance that the poppet member 72 may move away from the cylinder end 58. A second snap ring 78 retains the base member 74 fixed within the cylinder end 58. A coil compression spring 82, biases the poppet member 72 away from the base member 74, that is, in a direction away from the cylinder end 58 and toward the cylinder end 56. An O-ring 84 provides a seal between the periphery of the base member 74 and the cylinder 48.

The base member 74 has a central, tubular protuberance 86 that extends a preselected distance toward the poppet member 72. The spring 82 is disposed about the protuberance 86. The protuberance 86 includes an axial, central air passage 88, which extends through the member, that is, from one end or side of the member 74 to the other. The end of the central passage 88, which is adjacent to the cylinder end 58, is preferably open to the atmosphere.

A plurality (two being shown) of radially off-set, spaced apart axially extending air passages 92 and 94 also extend through the member 74, that is, from one end or side of the base member 74 to the other. As later described herein, the passages 88, 92 and 94 permit air to flow from the portion 96 of the cylinder 48, which is defined by the cylinder end 58 and the piston 46, through or across the base member 74. The total cross-sectional area of the passages 92 and 94 are significantly less than the cross-sectional area of the passage 88.

The poppet member 72 has an axial recess 98 that faces the base member 74 and that has a radial dimension such that the distal or projecting end of the protuberance 86 may be closely received within the recess. The recess 98 and the protuberance 86 are axially aligned and the axial depth of the recess is less than the projecting length of the distal end of the protuberance. When the poppet member 72 is moved toward the cylinder end 58 and into abutting contact with the distal end of the protuberance 86, the contact blocks the flow of air through the central passage 88. As noted, the spring 82 biases the poppet member 72 away from the base member 74 so that there is no contact between the distal end of the protuberance 86 and the adjacent, recess defined surface of the poppet member when the running web 16 is running through the system 12.

A plurality of radial slots, one of which is referenced at 102, extends between the recess 98 and the periphery of the poppet member 72. The poppet member 72 also includes a plurality of radially off-set, spaced apart axially extending air passages, two of which are referenced at 104 and 106. The passages 104 and 106 permit air communication across the member 72, that is, between the cylinder portion 96 and an annular space 108, which is defined between the members 72 and 74 and between the radially outwardly facing surface of the protuberance 86 and the cylinder 48. The slots 102 permit air communication between the annular space 108 and the interior of the recess 98, even when the protuberance 86 extends partially within the recess. Thus, during normal operation of the running web 16, the cylinder portion 96 is always in communication with the atmosphere.

The air passages 92 and 94 in the base member 74 also communicate with the annular space 108. Hence, even when the central passage 88 is blocked, air can flow from the portion 96 across through the member 72 and 74, via the passages 104 and 106, the annular space 108 and the passages 92 and 94 although the volume of air flowing is much reduced as compared to the volume of flow when the central passage 88 is open.

Nipples 112 and 114 are mounted in the passages 92 and 94, respectively. These nipples are both adapted to be connected with tubing 116 that includes, downstream, a conventional, variable air restrictor 118. The tubing 116 permits air in cylinder portion 96 to communicate, through the restrictor 118, with the atmosphere. In a conventional manner, the restrictor 118 imposes a preselected delay on the passage or bleeding of pressurized air through the tubing 116.

As noted, when the web 16 is running in a normal manner, the spring 82 biases the poppet member 72 away from the base member 74 so that air may flow from the cylinder portion 96, across the members 72 and 74 and out to the atmosphere, primarily through the central passage 88. Generally, some pressurized air in the cylinder portion 62 will leak across the piston 46 and into cylinder portion 96. The sizes of the passages 104, 106, 88, 92 and 94 are selected to accommodate this normal across-piston air flow and to prevent any increases in the air pressure in the cylinder portion 96 that might adversely effect the normal operation of the air cylinder assembly 42.

However, when a break in the running web 16 occurs, there is a rapid increase in the air pressure in the portion 96. This increase is due to the sudden movement of the piston 46 toward the cylinder end 58, which causes the poppet member to move toward the end 58, against the bias of the spring 82. This movement causes the member 72 to abut the distal end of the protuberance 86 and block further air flow through the central passage 88. Because of the differences of the total cross-section areas of the passage 92 and 94 (as compared with the cross-sectional area of passage 88) and because of the restrictor 118, such a blockage or closure of the passage 88 results in the rapid increase in the air pressure in the cylinder portion 96. The air pressure in the cylinder portion 96 continues to increase until the pressure equals the air pressure in cylinder portion 62. This air pressure increase in the portion 96 and the equalization of the air pressures in the portions 62 and 96 slows down, and then stops, in a controlled manner, the movement of the piston 46 and thus, the movement of the dancer assembly 34 upon a breakage of the running web 16.

The delay in the restrictor 118 is preselected so that the post-web-breakage movement of the piston 46 is substantially stopped before air is bled from the cylinder portion 96. For instance, a 4–5 second, or even a 2–3 second delay in the bleeding of the air from the portion 96 has been found to be satisfactory.

Referring again to FIG. 1, a conventional, two position, three way valve 122 is disposed in the tubing 124 and 126 and is adapted to connect the cylinder portion 62 with the regulator 66, which is also connected, via tubing 126 and a check valve 128, to a sump 132. The valve 122 may be a high flow, ½", 25VDC/120VAC, ½" JIC box option model manufactured by MAC Valves, Inc. of Wixom, Mich. 48393-7011. In its first or normal (illustrated) position, that is, its position when the web 16 is running, pressured air may flow between the cylinder portion 62 and the air pressure regulator 66 (and thus, to and from the air source 62 and sump 132, respectively).

A conventional transducer 134 is mounted so as to sense movement of the dancer assembly 34, and more particularly, the movement of the assembly 34 when the running web 16 breaks. As illustrated in FIG. 1, the transducer 134 is associated with the cable 44, but the transducer could also be associated directly with the assembly 34 itself. The transducer 134 may be a Magnetek/Gemco model (linear "Quik-Stik" 48" long with quick disconnect) manufactured by Patriot Sensors & Controls Corp. of Clawson, Mich. 48017-1097.

Upon movement of the dancer assembly 34 caused by a break in the running web, the transducer 134 sends a signal to the valve 122 to switch the valve from its first position (as illustrated in FIG. 1) to a second position where the communication between the cylinder portion 62 and the regulator 66 is blocked and where the cylinder portion 62 communicates, via tubing 124 and 136 with the tubing 116, upstream of the restrictor 118. Hence when a web breakage occurs, the valve 122 is immediately switched to its second position, and the valve portions 62 and 96 are brought into communication with each other, through the tubing 124, 136 and 116. This facilitates the equalization of the air pressures in the cylinder portions 62 and 96. As noted, the equalization of the air pressure controls and stops the upward movement of the dancer assembly 34 that would have otherwise occurred upon a break in the running web 16, in the absence of the present invention. With the movement of the valve 122 to its second position, the air pressure in cylinder portion 62, like that in cylinder portion 96, is permitted to bleed, after a preselected delay, through the restrictor 118 to the atmosphere.

The preferred embodiment of the present invention has now been described. This preferred embodiment constitutes the best mode presently contemplated by the inventor for carrying out his invention. Because the invention may be copied without copying the precise details of the preferred embodiment, the following claims particularly point out and distinctly claim the subject matter, which the inventor regards as his invention and wishes to protect:

What is claimed is:

1. In a method for controlling the speed and tension of a running web being unwound from a rotating roll and being run through a festoon and then to a web-using production process; where the festoon includes a relatively fixed entry idler, a relatively fixed exit idler and a vertically movable dancer about which the running web runs; where the dancer may be moved vertically, relatively with respect to the idlers, depending on the amount or quantity of running web being stored in the festoon; where the dancer is connected with a dancer tensioning cylinder assembly that is adapted to urge the dancer vertically against the force of the running web running over the dancer and that includes a cylinder having a first end and a second end, and a piston, which is movable within the cylinder, which is connected with the dancer, and which has a first surface facing the first end of the cylinder, and a second surface facing the second end of the cylinder; where a first portion of the cylinder is defined between the first end of the cylinder and the first surface of the piston; where a second portion of the cylinder is defined between the second end of the cylinder and the second surface of the piston; where a source of air under pressure supplies pressurized air to the first portion of the cylinder; where a regulator regulates the pressure of the pressurized air supplied to the first portion of the cylinder; and where the piston is movable within the cylinder in response to the air pressure being applied to the first portion of the cylinder and acting on the first surface of the piston, the improvement comprising steps of:

causing the pressure of the air in the second portion of the cylinder to increase after a break in the running web has occurred so that the pressure of the air in the second portion of the cylinder slows and then stops movement of the piston toward the second end of the cylinder; and bleeding the pressurized air in second portion of the cylinder from the second portion of the cylinder after a preselected delay after the break in the running web.

2. The improved method of claim 1 wherein the second portion of the cylinder is in communication with the atmosphere when the running web is running through the festoon; and where the method includes: the step of closing communication between the second portion of the cylinder and the atmosphere when the running web breaks so that the air in the second portion becomes pressurized and is applied to the second surface of the piston; the step of disconnecting the source of air under pressure from the first portion of the cylinder after a break in the running web has occurred; and the step of causing the first portion of the cylinder to come into communication with the second portion of the cylinder after a break in the running web has occurred.

3. The improved method of claim 2 wherein the step of closing communication between the second portion and the cylinder and the atmosphere results from the relatively rapid, initial movement of the piston toward the second end of the cylinder, the movement being caused by the breakage of the running web.

4. The improved method of claim 1 where the method includes: the step of sensing the occurrence of a break in the running web; the step of disconnecting the first portion of cylinder from the source of air under pressure upon the sensing of the occurrence of a breakage of the running web; and the step of also bleeding the pressurized air in the first portion of the cylinder from the cylinder after the preselected delay after the break in the running web is sensed.

5. The improved method of claim 4 wherein the second portion of the cylinder is in communication with the atmosphere when the running web is running through the festoon; and where the method includes causing, the first portion of the cylinder to come into communication with the second portion of the cylinder and closing communication between the second portion of the cylinder and the atmosphere after a break in the running web has occurred so that the air in the second portion becomes pressurized and is applied to the second surface of the piston and so that the pressure of the air in the second portion of the cylinder becomes equal to the pressure of the air in the first portion of the cylinder.

6. The improved method of claim 5 wherein the step of closing communication between the second portion of the cylinder and the atmosphere results from the relatively rapid, initial movement of the piston toward the second end of the cylinder, the movement being caused by the breakage of the running web.

7. In a system for controlling the speed and tension of a running web being unwound from a rotating roll and being run through a festoon and then to a web-using production process; where the festoon includes a relatively fixed entry idler, a relatively fixed exit idler, and a vertically movable dancer about which the running web runs; where the dancer may be moved vertically, relatively with respect to the idlers, depending on the amount or quantity of running web being stored in the festoon; where the dancer is connected with a dancer tensioning cylinder assembly that is used to urge the dancer vertically against the force of the running web running over the dancer and that includes a cylinder, having a first end and a second end, and a piston, which is connected with the dancer, which is movable within the cylinder, and which has having a first surface facing the first end of the cylinder and a second surface facing the second end of the cylinder; where a first portion of the cylinder is defined between the first end of the cylinder and the first face of the piston; where a second portion of the cylinder is defined between the second end of the cylinder and the second surface of the piston; where the system includes a source of air under pressure that is adapted to be applied to the first portion of the cylinder and an air regulator for regulating the pressure of the pressurized air supplied to the first portion of the cylinder; and where the piston is movable within the cylinder in response to the air pressure being applied to and acting on the first surface of the piston, the improvement comprising:

A first valve that is adapted to be moved between a first position where the second portion of the cylinder is in communication with the atmosphere and a second position where communication between the second portion of the cylinder and the atmosphere is closed so that the pressure of the air in the second portion increases and so that movement of the piston toward the second end of the piston slows and then stops after a breakage of the running web occurs; the first valve being moved from its first position to its second position when a breakage of the running web occurs; and an air flow restrictor that permits air in the second portion of the cylinder to bleed from the second portion after a preselected delay after the break in the running web has occurred.

8. The improved system of claim 7 wherein the system includes:

a second valve that is adapted to be moved between a first position where the source of the pressurized air is connected with the first portion of the cylinder and a second position where the source of pressurized air is disconnected from the first portion of the cylinder and the first portion of the cylinder is connected with the air flow restrictor so that after the preselected delay, the pressurized air in the first portion of the cylinder is permitted to bleed from the first portion of the cylinder; and wherein the system also includes a sensor that is adapted to sense the breakage of the running web and in response to the breakage of the running web, to activate the second valve so that the second valve is moved from the first position to the second position.

9. The improved system of claim 8 wherein the system includes a sensor that senses movement of the piston, and wherein the second valve is moved from the first position to the second position by reason of the sensor sensing relatively rapid, initial movement of the piston toward the second end of the cylinder upon a breakage of the running web.

10. The improved system of claim 9 wherein the first valve is moved from the first position to the second position by reason of the relatively rapid, initial movement of piston toward the second end of the cylinder upon a breakage of the running web.

* * * * *